United States Patent [19]

Hayakawa et al.

[11] Patent Number: 4,896,907

[45] Date of Patent: Jan. 30, 1990

[54] LOCKING DEVICE FOR A VEHICLE

[75] Inventors: Hatsuo Hayakawa; Mikio Honma, both of Yokohama, Japan

[73] Assignee: Ohi Seisakusho Co., Ltd., Kanagawa, Japan

[21] Appl. No.: 297,657

[22] Filed: Jan. 17, 1989

Related U.S. Application Data

[63] Continuation of Ser. No. 121,610, Nov. 17, 1987, abandoned.

[30] Foreign Application Priority Data

Nov. 18, 1986 [JP] Japan ..... 61-272819

[51] Int. Cl.[4] ..... E05C 3/26

[52] U.S. Cl. ..... 292/216; 292/DIG. 41

[58] Field of Search ..... 292/216, 280, 147, 210, 292/201, DIG. 23, DIG. 24, 108

[56] References Cited

U.S. PATENT DOCUMENTS

| | | | |
|---|---|---|---|
| 635,352 | 10/1899 | Samtelle | 292/147 |
| 2,877,038 | 3/1959 | Kramer | 292/216 |
| 3,347,584 | 10/1967 | Johnstone | 292/198 |
| 3,504,511 | 4/1970 | Allen | 70/241 |
| 3,709,537 | 1/1973 | Kazaoka et al. | 292/216 |
| 3,848,911 | 11/1974 | Watermann et al. | 292/216 |
| 3,917,330 | 11/1975 | Quantz | 292/216 |
| 4,163,443 | 8/1979 | Peterson | 126/197 |
| 4,703,961 | 11/1987 | Weinerman et al. | 292/216 |

*Primary Examiner*—Richard E. Moore

*Attorney, Agent, or Firm*—Zarley, McKee, Thomte, Voorhees & Sease

[57] ABSTRACT

A locking device for a vehicle is disclosed, which comprises a latch lever capable of being rotated in mesh with a striker being advanced, a locking lever for engaging with and thereby blocking the rotation of the latch lever, the latch lever and locking lever being pivotally mounted on a base plate, and a locking lever provided on the base plate for engaging with the side of the locking lever or latch lever opposite the base plate and thereby blocking the movement of the engaging lever away from the surface of the base plate.

11 Claims, 3 Drawing Sheets

LOCKING DEVICE FOR A VEHICLE

This application is a continuation of application Ser. No. 121,610 filed Nov. 17, 1987, now abandoned.

BACKGROUND OF THE INVENTION 1. (Field of The Invention)

This invention relates to a structure for improving the mechanical strength of a locking device, e.g., a hood lock or a door lock of a vehicle.

2. (Description of the Prior Art)

In the conventional hood lock device of a vehicle is constructed in general as follows.

That is, the device comprises a base plate secured to and depending substantially vertically from the vehicle body. The device also comprises a latch lever and a locking lever, these levers being pivotally mounted by respective pins on base plate. The latch lever is rotated in mesh with a striker entering a U-shaped notch, which is formed in the base plate such that it extends downwardly from the upper edge of the base plate when the hood is closed. The locking lever serves to engage with the latch lever to prevent the rotation of the latch lever.

Further, there are comprised a tension spring biasing the latch lever in the direction to detach the striker from the notch, a tension spring biasing the locking lever in the direction to cause engagement of the locking lever with the latch lever, a secondary latch lever pivoted by a pin on the base plate on the side thereof opposite the side where the locking lever being provided, an operating section of the secondary latch lever, a tension spring biasing in the direction, in which a secondary latch lever is engaged with the striker base provided on the hood, and a wire connecting the lower end of the locking lever and operating handle in the vehicle body.

This hood lock device operates as follows.

When the locking lever is turned from the state, in which the hood is closed, via the wire by pulling the operating handle in the vehicle body, the latch lever is released, whereby the striker is raised by the biasing force of the tension spring so that the hood is raised to a secondary latch position, at which the secondary latch lever is engaged with the striker base.

Subsequently, the operating section is pushed with a hand inserted through a gap between the front portion of the vehicle body and the front end of the slightly opened hood. Consequently, the secondary latch lever is rotated so that its upper end is detached from the striker base. Now, the hood can be opened perfectly.

When closing the hood, the striker base passes by causing displacement of the upper end of the secondary latch lever, while the striker is advanced into the notch of the base plate to cause rotation of the latch lever.

When the latch lever is rotated up to the position the locking lever is engaged with the latch lever to prevent rotation of the latch lever. The hood is thus held in a perfectly closed state.

With the prior art locking device having the above structure, when a sudden impact load is exerted in the direction to cause detachment of the striker from the notch of the base plate at the time of a collision of the vehicle or the like, the impact load is concentrated on the pins via the meshing portions of the latch lever and locking lever.

In such a case, portions of the base plate supporting the pins are liable to be deformed because the base plate made of a material, which does not provide a considerably high mechanical strength, although the latch lever and locking lever are imparted with high mechanical strength by annealing or like treatment. When the base plate is deformed, the pins are tilted to cause tilting of lower portions of the latch lever and locking lever away from the base plate. In such a case, the latch lever and locking lever are liable to be detached from each other due to the difference in the extent of tilting of the latch lever and locking lever.

Experiments prove that the latch lever has a greater tendency of tilting away from the base plate than the locking lever.

This invention has a purpose of providing a locking device for a vehicle, which is improved with an aim of solving the problem noted above.

SUMMARY OF THE INVENTION

It is the object of the present invention to provide a novel locking device for a vehicle, which comprises a latch lever capable of being rotated in mesh with a striker being advanced, a locking lever for engaging with and thereby blocking the rotation of the latch lever, the latch lever and locking lever being pivotally mounted on a base plate, and a locking lever provided on the base plate for engaging with the side of the locking lever or latch lever opposite the base plate and thereby blocking the movement of the engaged lever away from the surface of the base plate.

With the locking device for a vehicle according to the invention, when a shock load is exerted to the device as noted above, the separation of the lever and base plate about the pin, which mounts the lever on the base plate, by the engagement of the locking member provided on the base plate with the locking lever or latch lever. In this way, it is possible to prevent deformation of the portions of the base plate supporting the lever-mounting pins, and shock loads as noted above can be withstood up to a considerable extent without detachment of the two levers from each other.

DETAILED DESCRIPTION OF PREFERRED EMBODIMENTS

Figure 13:
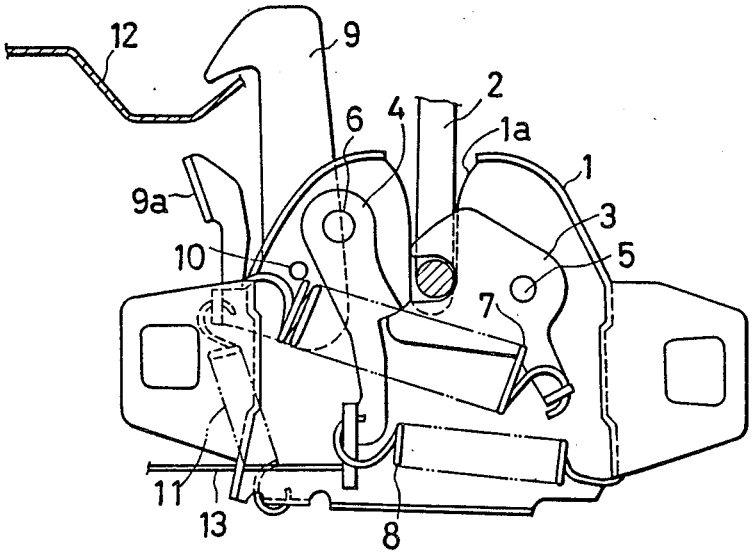
FIG. 13 is a front view showing a prior art hood locking device for a vehicle.

Prior to describing an embodiment of the present invention, for better understanding we herewith discuss one of the conventional hook lock device referring to FIG. 13.

FIG. 13 shows a prior art hood lock device of a vehicle. The device comprises a base plate 1 secured to and depending substantially vertically from the vehicle body, (not shown). The device also comprises a latch lever 3 and a locking lever 4, these levers being pivotally mounted by respective pins 5 and 6 on base plate 1. The latch lever 3 is rotated in mesh with a striker 2 entering a U-shaped notch 1*a*, which is formed in the base plate 1 such that it extends downwardly from the upper edge of the base plate 1 when the hood is closed. The locking lever 4 serves to engage with the latch lever 3 to prevent the rotation of the latch lever 3.

Reference numeral 7 designates a tension spring biasing the latch lever 3 in the counterclockwise direction in FIG. 13, i.e., in the direction to detach the striker 2 from the notch 1*a*. Reference numeral 8 designates a tension spring biasing the locking lever 4 in the counterclockwise direction in FIG. 13, i.e., in the direction to cause engagement of the locking lever 4 with the latch lever 3. Reference numeral 9 designates a secondary latch lever pivoted by a pin 10 on the base plate 1 on the side thereof opposite the side where the locking lever 3 is provided. Reference numeral 9*a* designates an operating section of the secondary latch lever. Reference numeral 11 designates a tension spring biasing in the counterclockwise direction in FIG. 13, i.e., in the direction, in which a secondary latch lever 9 is engaged with the striker base 12 provided on the hood. Reference numeral 13 designates a wire connecting the lower end of the locking lever 4 and operating handle (not shown) in the vehicle body.

This hood lock device operates as follows.

When the locking lever 4 is turned in the clockwise direction in FIG. 13 from the state shown in FIG. 13, in which the hood is closed, via the wire 13 by pulling the operating handle in the vehicle body, the latch lever 3 is released, whereby the striker 2 is raised by the biasing, force of the tension spring 7 so that the hood is raised to a secondary latch position, at which the secondary latch lever 9 is engaged with the striker base 12. Subsequently, the operating section 9*a* is pushed to the right in FIG. 13 with a hand inserted through a gap between the front portion of the vehicle body and the front end of the slightly opened hood. Consequently, the secondary latch lever 9 is rotated in the clockwise direction in FIG. 13 so that its upper end is detached from the striker base 12. Now, the hood can be opened perfectly.

When closing the hood, the striker base 12 passes by casing a rightward displacement of the upper end of the secondary latch lever 9 in FIG. 13, while the striker 2 is advanced into the notch 1*a* of the base plate 1 to cause rotation of the latch lever 3 to the position shown in FIG. 13.

When the latch lever 3 is rotated up to the position shown in FIG. 13, the locking lever 4 is engaged with the latch lever 3 to prevent rotation of the latch lever 3 in the clockwise direction in FIG. 13. The hood is thus held in a perfectly closed state.

Now, an embodiment of the invention will be described with reference to the drawings. Parts identical with or like those in the above example are designated by like reference numerals, and their detailed description is omitted.

FIGS. 1 to 4 show a first embodiment of the invention.

In this first embodiment, the front side of the base plate 1 is provided below the notch 1*a* with a transversally elongate rectangular raised portion 22 having opposite end outward projections 21. The raised portion 22 is formed integrally with the base plate 1 with a press. With this arrangement, when the locking lever 4 reaches an engagement position shown in FIG. 1 to engage the latch lever 3, it is stopped in engagement with the right end of the raised portion 22 with an intermediate portion of its left edge held clamped between the right end projection 21 of the raised portion 22 and the base plate 1.

Figure 1:
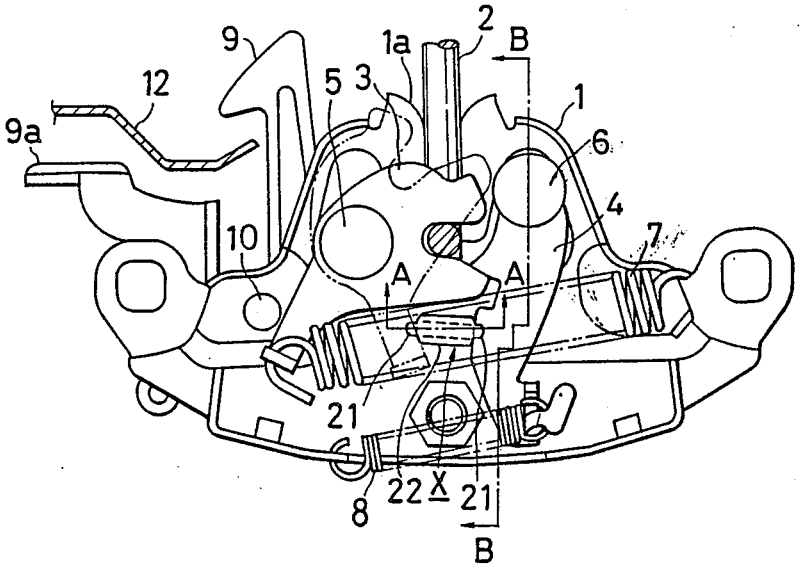
FIG. 1 is a front view showing a first embodiment of the invention.

As for the left end of the raised portion 22, when the latch lever 3 is detached from the latch lever 3 and reaches an open position, as shown by an imaginary line in FIG. 1, in which the advancement of the striker 2 is permitted, it is topped in contact with the left end of the raised portion 22 with its right edge held clamped between the left end projection 21 and the base plate 1.

Figure 2:
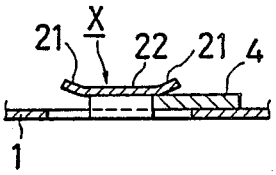
FIG. 2 is an enlarged-scale sectional view taken along line A—A in FIG. 1.
Figure 3:
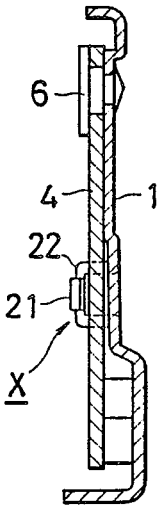
FIG. 3 is an enlarged-scale sectional view taken along line B—B in FIG. 1.
Figure 4:
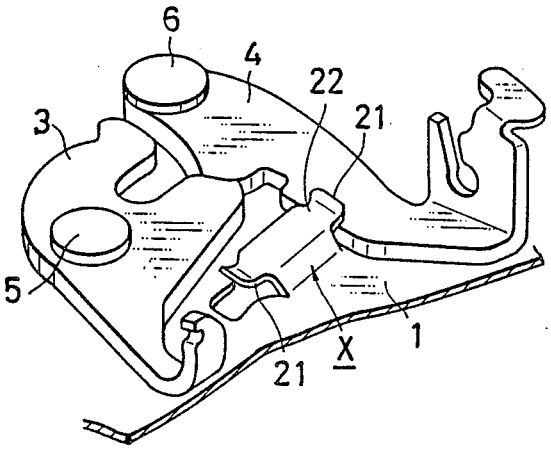
FIG. 4 is a perspective view showing an essential part of the embodiment.

As shown clearly in FIG. 2, each end projection 21 has a slightly forwardly inclined end portion so that the locking lever 4 or latch lever 3 can be guided smoothly.

In the first embodiment, the raised portion 22 having the end projections 21, serves as engaging member X to block movement of the levers 3 and 4 away from the surface of the base plate 1 and also serves the role of a stopper for the locking lever 4 and latch lever 3.

With the construction of the first embodiment, when a shock load is exerted in the direction to cause detachment of the striker 2 from the notch la at the time of a collision of a vehicle or the like with the hood in the perfectly closed state as shown by solid line in FIG. 1, the displacement of the lower portion of the locking lever 4 away from the base plate, i.e., in the forward direction, is prevented since the right end projection 21 is in engagement with the front surface of the locking lever 4. Thus, it is possible to prevent deformation of the portion of the base plate 1 where the locking lever 4 is pivotally mounted.

An important aspect of the present invention is the provision of the engaging member on the base plate for restraining the degree of inclination of the locking plate, so as to reinforce the engagement of the latch lever and the locking plate, particularly in the event of a large load being applied when the striker is engaged with the latch lever and the latch lever is engaged with the locking plate, i.e., when the door or hood of the vehicle is closed.

In the present invention, the position of the engaging member X is very important. More particularly, the position from the engaging member to the pin 6 must be larger than the distance between the pin 6 and the point of engagement between the latch lever 3 and the locking lever 4. This positioning of the engagement member X further from the pin 6 than the contact surfaces of the latch lever 3 and the locking lever 4 is clearly shown in FIGS. 4 and 5. Thus, with minimal restricting forces, it is possible to restrict the inclination of the locking lever 4. Thus, the dimensions of the locking device, including thickness and weight can be minimized.

Certain mechanical strength tests reveal that when striker 2 is held engaged in a hood lock device which is not provided with the raised portion 22 and then raised in this state, portions of the base plate 1 surrounding the pins 5 and 6 are deformed by a load of approximately 482 kg, resulting in tilting of the pins 5 and 6 and detachment of meshing portions of the locking lever 4 and latch lever 3 in the thickness direction thereof.

For the sake of comparison, the same mechanical strength tests were conducted with the same construction as above except for that the raised portion 22 with the end projections 21 were provided. It was found that a load up to approximately 1,040 kg was withstood, and the meshing portions of the locking lever 4 and latch lever 3 were detached from each other due to deformation and breaking.

Figure 5:
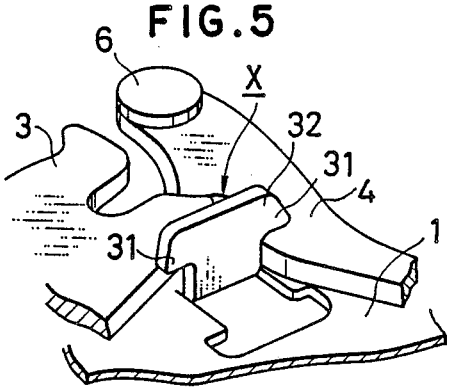
FIG. 5 is a fragmentary sectional view showing an essential part of a second embodiment of the invention.

FIG. 5 shows a second embodiment of the invention.

In the second embodiment, an engaging member X was formed by forming the base plate 1 with a substantially T-shaped cut-and-bent portion 32 having outwardly directed opposite end projections 31. The locking lever 4 and latch lever 3 are adapted to be engaged with the inner side of the end projections 31.

With this construction, the same operation and effects as in the case of the first embodiment can be obtained.

Figure 6:
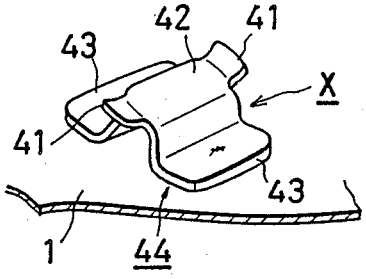
FIG. 6 is a perspective view showing a member used in a third embodiment of the invention.

FIG. 6 shows a member used in a third embodiment of the invention.

In this embodiment, a steel plate member 44, which has mounting portions 43 integral with the upper and lower edges of a raised member 42 having the same shape as the raised portion 22 in the first embodiment, is formed separately from the base plate 1. An engaging member X is formed by securing the mounting portions 43 of the member 44 to the base plate 1 by means of spot welding. The same operation and effects as in the case of the first embodiment can be obtained.

Reference numeral 41 designates end projections which are the same as the end projections 21.

Figure 7:
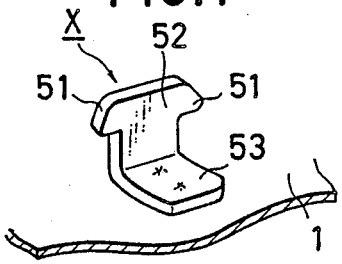
FIG. 7 is a perspective view showing a member used in a fourth embodiment of the invention.

FIG. 7 shows a fourth embodiment of the invention.

In this embodiment, a stem portion of a member 52, which has the same shape as the cut-and-bent portion 32 in the second embodiment of FIG. 5 has a substantially perpendicularly bent mounting portion 53. An engaging member X which is the same as in the case of the second embodiment is formed by securing the mounting portion 53 to the base plate 1 by means of spot welding. The same operation and effects as in the case of the second embodiment can be obtained.

Figure 8:
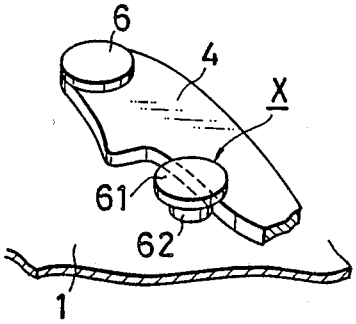
FIG. 8 is a fragmentary perspective view showing an essential part of a fifth embodiment of the invention.

FIG. 8 shows a fifth embodiment of the invention.

In this embodiment, a pin 62 with a head portion 61 having an increased diameter is formed such that it projects from the front surface of the base plate 1, so that the same operation and effects as in the other embodiments can be obtained with the advancement of the edge portion of the locking lever 4 into the gap between the head portion 61 and base plate 1. In this embodiment, the pin 62 serves as an engaging member X.

Figure 9:
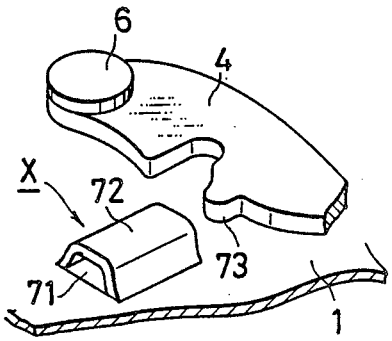
FIG. 9 is a fragmentary perspective view showing an essential part of a sixth embodiment of the invention.
Figure 10:
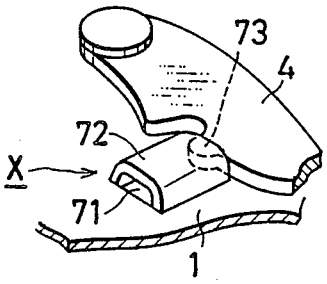
FIG. 10 is a perspective view showing the same embodiment with a locking lever in mesh with a raised portion.

FIGS. 9 and 10 show a sixth embodiment of the invention.

In this embodiment, a transversally elongate hollow member 72 having opposite end openings 71 is formed with a press on a suitable portion of the base plate 1. When the locking lever 4 reaches an engagement position, its projection 73 formed on one edge enters one of the openings 71 of the hollow member 72. The same operation and effects as in the other embodiments thus can be obtained.

In this embodiment, the hollow member 72 with the end openings 71 serves as engaging member X.

Figure 11:
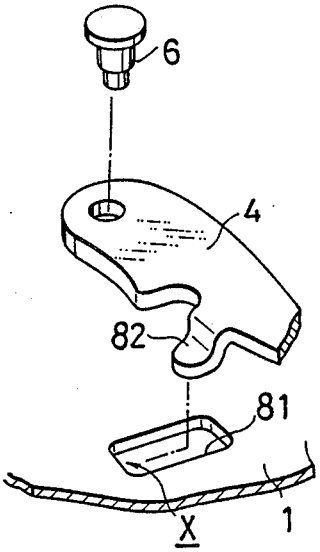
FIG. 11 is an exploded perspective view showing a seventh embodiment of the invention.

FIG. 11 shows a seventh embodiment of the invention.

This embodiment is a modification of the sixth embodiment. In this case, on the base plate 1 there is formed an arcular slot 81 centered on the pins 6. Also, the locking lever 4 has one edge provided with an L-shaped projection 82, which is adapted to engage with the rear surface of one end of the slot 81 when the locking lever 4 reaches an engagement position.

In this embodiment, one end of the slot 81 serves as engaging member X.

Figure 12:
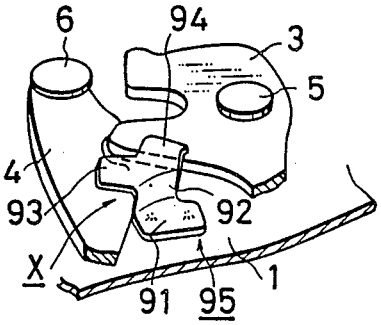
FIG. 12 is a fragmentary perspective view showing an essential part of an eighth embodiment of the invention.

FIG. 12 shows an eighth embodiment of the invention.

In this embodiment, the engaging member X is constituted by a metal member 95, which has a mounting portion 91 secured to the base plate 1, an upright portion 92 extending forwardly from the mounting portion 91, and projections 93 and 94 extending from the other end of the upright portion 92. The projection 93 engages with the front surface of one side of the locking lever 4 when the lever 4 reaches an engagement position. The projection 94 engages the front surface of one side of the latch lever 3 when the lever 3 reaches a full latch position, at which the lever 3 is restricted by the locking lever 4.

In this embodiment, when the hood is completely closed, the projection 93 and 94 engage respectively with the front surfaces of the locking lever 4 and latch lever 3, thus simultaneously and reliably preventing the movement of the levers 4 and 3 away from the base plate 1.

The embodiment of the invention described above are by no means limitative, and various changes and modifications are possible.

Further, the invention is applicable to locking devices other than the hood lock device, e.g., a door lock device.

(Effects of the Invention)

As has been described in the foregoing, according to the invention the movement of the locking lever or latch lever away from the base plate is prevented by a locking member provided on the base plate, thus preventing the deformation of portions of the base plate supporting the lever mounting pins and thus improved the mechanical strength of the mesh between the two levers.

What is claimed is:

1. A locking device for a vehicle having a body, a door or hood pivotally connected to the body for opening and closing movement, and a striker on the door or hood, the device comprising:

a base plate securable to a body of a vehicle;

a latch lever and a locking lever pivotally mounted on the base plate;

said latch lever being rotatable in mesh with a striker as the door or hood of a vehicle closes;

said locking lever being engagable with said latch lever to block rotation of the latch lever;

an engaging means provided on said base plate for engaging with the side of said locking lever or latch lever opposite to said base plate and thereby blocking the movement of said lever away from the surface of said base plate; and wherein the distance from said engaging means to the pivotal connection of the engaged lever is larger than the distance between said pivotal connection and the point of engagement between said latch lever and said locking lever.

2. A locking device according to claim 1 wherein said base plate is provided with a transversally elongated rectangular raised portion having opposite outwardly directing end projections.

3. A locking device according to claim 1 wherein said base plate is provided with a transversally elongate rectangular raised portion having opposite outwardly directing end projections.

4. A locking device according to claim 2, wherein said opposite outwardly directing projections are slightly forwardly inclined to guide said locking lever or latch lever smoothly.

5. A locking device according to claim 1, wherein said engaging means includes a substantially T-shaped cut-and-bent portion having outwardly directed opposite end projections formed in said base plate.

6. A locking device according to claim 1, wherein said engaging means is formed by a plate member having mounted portions integral with the upper and lower edges of a raised member being formed separately from said base plate, said mounting portions of said plate member being secured to said base plate.

7. A locking device according to claim 1, wherein said engaging means is formed by a stem portion of a member having a substantially perpendicularly bent mounting portion being secured to said base plate.

8. A locking device according to claim 1, wherein said engaging means is formed by projectedly mounting a pin with a head portion having an increased diameter at the front surface of said base plate so that the edge portion of said locking lever or latch lever advances into a gap between said head portion and said base plate.

9. A locking device according to claim 1, wherein said engaging means is composed of a transversally elongate hollow member formed on said base plate and having en end opening, said locking lever or latch lever having a projection formed on one edge thereof which is receivable in the opening of said hollow member when said locking lever or latch lever reached to an engagement position.

10. A locking device according to claim 1, wherein said engaging means is composed of a slot provided in said base plate, and an L-shaped projection which is provided on one edge of said locking lever or latch lever and which is adapted to be received in the slot and engage the base plate adjacent said slot, when said locking lever or latch lever reaches to an engagement position.

11. A locking device according to claim 1, wherein said engaging means is composed of a member having a mounting portion secured to said base plate, said member having an upright portion extending forwardly from said mounting portion, and a pair of projections extending from the end of said upright portion, wherein one of said projection is adapted to engage with the front surface of one side of said locking lever when said lever reaches to an engagement position, and the other projection is adapted to engage with the front surface of one side of said latch lever when said latch lever reaches to a full latch position.

* * * * *